US009220298B1

(12) United States Patent
En'Wezoh et al.

(10) Patent No.: US 9,220,298 B1
(45) Date of Patent: Dec. 29, 2015

(54) TECHNOLOGIES FOR SMOKING

(71) Applicant: Viiital, LLC, Kennewick, WA (US)

(72) Inventors: Zachary J. En'Wezoh, Kennewick, WA (US); Brandon I. En'Wezoh, Kennewick, WA (US)

(73) Assignee: Viiital, LLC, Kennewick, WA (US)

( * ) Notice: Subject to any disclaimer, the term of this patent is extended or adjusted under 35 U.S.C. 154(b) by 0 days.

(21) Appl. No.: 14/571,064

(22) Filed: Dec. 15, 2014

Related U.S. Application Data

(60) Provisional application No. 62/050,124, filed on Sep. 13, 2014.

(51) Int. Cl.
*A24D 1/00* (2006.01)
*A24D 1/18* (2006.01)
*A24C 5/00* (2006.01)

(52) U.S. Cl.
CPC .... *A24D 1/18* (2013.01); *A24C 5/00* (2013.01)

(58) Field of Classification Search
CPC ..... A24D 1/006; A24D 1/008; A24D 1/004; A23C 5/476
USPC ..... 131/361, 349, 360
See application file for complete search history.

(56) References Cited

U.S. PATENT DOCUMENTS

| | | | | |
|---|---|---|---|---|
| 1,931,131 | A * | 10/1933 | Haley | 131/349 |
| 3,062,218 | A * | 11/1962 | Temkovits | 131/331 |
| 3,194,246 | A * | 7/1965 | Mantchev | 131/187 |
| 4,677,995 | A | 7/1987 | Kallianos et al. | |
| 4,687,008 | A | 8/1987 | Houck, Jr. et al. | |
| 4,893,639 | A | 1/1990 | White | |
| 5,730,160 | A | 3/1998 | Schneider | |
| 7,998,274 | B2 | 8/2011 | Rodrigues et al. | |
| 8,413,665 | B2 | 4/2013 | Estrella Gomez | |
| 2004/0144660 | A1* | 7/2004 | Staiano | 206/236 |
| 2006/0272659 | A1 | 12/2006 | Kobal et al. | |
| 2009/0277465 | A1 | 11/2009 | Karles et al. | |
| 2012/0024305 | A1 | 2/2012 | Liu et al. | |
| 2012/0204889 | A1 | 8/2012 | Xiu | |
| 2014/0166029 | A1 | 6/2014 | Weigensberg et al. | |
| 2014/0190503 | A1 | 7/2014 | Li et al. | |

* cited by examiner

*Primary Examiner* — Richard Crispino
*Assistant Examiner* — Dionne W Mayes
(74) *Attorney, Agent, or Firm* — Dentons US LLP

(57) ABSTRACT

A kit is provided. The kit comprises a plurality of units. Each of the units comprises a tube comprising an open end. The tube contains a first smokable material recessed with respect to the end so that an open space within the tube is defined thereby between the end and the first material. The end is sized to receive a cigarette portion comprising a second smokable material so that the portion is positioned within the space so that the first material and the second material abut each other.

15 Claims, 4 Drawing Sheets

TECHNOLOGIES FOR SMOKING

CROSS-REFERENCE TO RELATED APPLICATIONS

The present application claims the benefit of U.S. Provisional Patent Application Ser. No. 62/050,124, filed on Sep. 13, 2014, which is herein fully incorporated by reference for all purposes.

TECHNICAL FIELD

The present disclosure relates to smoking.

BACKGROUND

In the present disclosure, where a document, an act and/or an item of knowledge is referred to and/or discussed, then such reference and/or discussion is not an admission that the document, the act and/or the item of knowledge and/or any combination thereof was at the priority date, publicly available, known to the public, part of common general knowledge and/or otherwise constitutes prior art under the applicable statutory provisions; and/or is known to be relevant to an attempt to solve any problem with which the present disclosure is concerned with. Further, nothing is disclaimed.

A smoker smokes tobacco via at least one of a cigarette and a cigar. Often, the smoker desires to smoke another smokable material, while smoking the at least one of the cigarette and the cigar. However, such desire is not simple to attain for various reasons, such as effectiveness, costs, assembly, or convenience.

BRIEF SUMMARY

The present disclosure at least partially addresses at least one of the above. However, the present disclosure can prove useful to other technical areas. Therefore, the claims should not be construed as necessarily limited to addressing any of the above.

According to an example embodiment of the present disclosure a kit is provided. The kit comprises a plurality of units. Each of the units comprises a tube comprising an open end. The tube contains a first smokable material recessed with respect to the end so that an open space within the tube is defined thereby between the end and the first material. The end is sized to receive a cigarette portion comprising a second smokable material so that the portion is positioned within the space so that the first material and the second material abut each other.

According to an example embodiment of the present disclosure a method is provided. The method comprises inserting a cigarette portion into an open end of a tube. The tube containing a first smokable material recessed with respect to the end so that an open space within the tube is defined thereby between the end and the first material. The portion comprising a second smokable material. The method further comprising abutting the first material and the second material so that the portion is positioned within the space.

The present disclosure may be embodied in the form illustrated in the accompanying drawings. However, attention is called to the fact that the drawings are illustrative. Variations are contemplated as being part of the disclosure, limited only by the scope of the claims.

BRIEF DESCRIPTION OF THE DRAWINGS

The accompanying drawings illustrate example embodiments of the present disclosure. Such drawings are not to be construed as necessarily limiting the disclosure. Like numbers and/or similar numbering scheme can refer to like and/or similar elements throughout.

DETAILED DESCRIPTION OF THE PREFERRED EMBODIMENTS

Figure 1:
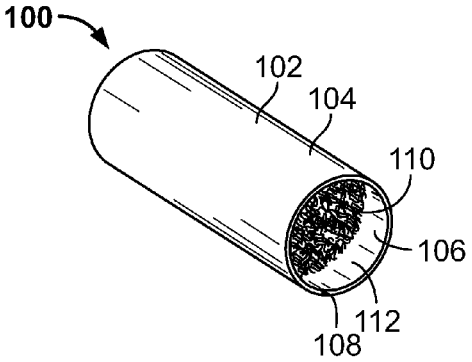
FIG. 1 shows a perspective view of an example embodiment of a unit according to the present disclosure.

The present disclosure is now described more fully with reference to the accompanying drawings, in which example embodiments of the present disclosure are shown. The present disclosure may, however, be embodied in many different forms and should not be construed as necessarily being limited to the example embodiments disclosed herein. Rather, these example embodiments are provided so that the present disclosure is thorough and complete, and fully conveys the concepts of the present disclosure to those skilled in the relevant art.

Features described with respect to certain example embodiments may be combined and sub-combined in and/or with various other example embodiments. Also, different aspects and/or elements of example embodiments, as disclosed herein, may be combined and sub-combined in a similar manner as well. Further, some example embodiments, whether individually and/or collectively, may be components of a larger system, wherein other procedures may take precedence over and/or otherwise modify their application. Additionally, a number of steps may be required before, after, and/or concurrently with example embodiments, as disclosed herein. Note that any and/or all methods and/or processes, at least as disclosed herein, can be at least partially performed via at least one entity in any manner.

The terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

Although the terms first, second, etc. can be used herein to describe various elements, components, regions, layers and/or sections, these elements, components, regions, layers and/or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from the teachings of the present disclosure.

The terminology used herein is for describing particular example embodiments and is not intended to be necessarily limiting of the present disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence and/or addition of one or more other features, integers, steps, operations, elements, components, and/or groups thereof.

As used herein, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (30) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, a gemstone, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" can be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings were turned over, then the elements described as being on the "lower" side of other elements would then be oriented on "upper" sides of the other elements. Similarly, if the device in one of the figures were turned over, elements described as "below" or "beneath" other elements would then be oriented "above" the other elements. Therefore, the example terms "below" and "lower" can encompass both an orientation of above and below.

As used herein, the term "about" and/or "substantially" refers to a +/−10% variation from the nominal value/term. Such variation is always included in any given value/term provided herein, whether or not such variation is specifically referred thereto.

If any disclosures are incorporated herein by reference and such disclosures conflict in part and/or in whole with the present disclosure, then to the extent of conflict, and/or broader disclosure, and/or broader definition of terms, the present disclosure controls. If such disclosures conflict in part and/or in whole with one another, then to the extent of conflict, the later-dated disclosure controls.

FIG. 1 shows a perspective view of an example embodiment of a unit according to the present disclosure. A unit 100 comprises a rectilinear tube 102 comprising an outer surface 104 and an inner surface 106. The tube 102 comprises an open end 108. The tube 102 contains a smokable material 110 recessed with respect to the end 108 so that an open space 112 within the tube 102 is defined thereby between the end 108 and the material 110.

The tube 102 comprises rolling paper, but can comprise other materials, whether additionally or alternatively, whether in a raw material state or in a processed state, such as plastic, wood, leaves, metal, foil, rubber, gemstone, hardened foam, or glass. The tube 102 can be configured for a single use, such as via being disposable upon use or unusable upon use. The tube 102 can be configured to be at least human food safe or at least human edible, such as by being safe at least for human eating, such as via comprising a food safe chemical, a fruit portion, a vegetable portion, a plant portion, a stem portion, a branch portion, or a leaf portion. For example, such human can be of any gender between age 21 and 65. For example, the tube 102 can be configured to taste sweet, bitter, salty, sour, or any other taste or flavor, including other foods or drinks. The tube 102 can be configured to dissolve upon exposure to moisture, such as water, juice, beverage, or any other liquid, whether or not configured to be at least human food safe or at least human edible.

The tube 102 is a right circular cylinder, but can be shaped differently, whether in length, width, height, or thickness, whether uniform or varying, whether symmetrical or asymmetrical, whether in part or in whole. For example, the tube 102 can comprise a triangular cross-section, a rectangular cross-section, a pentagonal cross-section, a trapezoidal cross-section, a square cross-section, an arcuate longitudinal extension, a wavy longitudinal extension, a helical longitudinal extension, a spiral longitudinal extension, a curved longitudinal extension, a varying vertical extension, a constant vertical extension, a conical longitudinal extension, a tapered longitudinal extension, a uniform thickness, a varying thickness, a uniform height, a varying height, a uniform width, a varying width, or any combinations thereof along at least one of at least four characteristics, including length, width, height, and thickness.

The tube 102 can be a single structurally continuous piece or be defined via an assembly of sub-pieces. For example, such assembly can be via fastening, mating, interlocking, adhering, or any other suitable form of coupling. For example, the tube 102 can be shaped as or be a part of a shape shaped as at least one of a Q-shape, a W-shape, an E-shape, an R-shape, a T-shape, a Y-shape, a U-shape, a P-shape, an A-shape, an S-shape, an F-shape, a G-shape, an H-shape, a J-shape, a K-shape, an L-shape, a Z-shape, an X-shape, a C-shape, a V-shape, an N-shape, an M-shape, or any other alphanumerical symbol in any language, such as via being Latin-based, Cyrillic-based, Hebrew-based, Arabic-based, or Asian-based, such as Mandarin, whether with or without a serif. The tube 102 can be rigid, flexible, stretchable, or elastic. The tube 102 can be solid or perforated, whether in any part or in whole. The tube 102 can be configured to be waterproof.

At least one of the outer surface 104 and the inner surface 106 can be smooth, rough, textured, rugged, uncoated, or coated with an agent configured to improve or degrade at least one of a smoking quality, a smoking flavor, a filtering characteristic, a smoldering characteristic, or affect in any way an aspect of smoking via the unit 100.

The end 108 is extending perpendicular to the rectilinear extension of the tube 102. However, in other embodiments, the end 108 is extending non-perpendicular to the rectilinear extension of the tube 102, such as via being beveled by being diagonal to the rectilinear extension of the tube 102, whether with a positive slope or a negative slope, or arcuate, whether concave or convex.

The material 110 is comprises tobacco, such as a tobacco blend. However, the material 110 can be any smokable material, whether in a raw material state or in a processed state, whether flavored or unflavored, whether or not configured to be at least human food safe or at least human edible. For example, the material 110 can comprise tobacco, cannabis, mesquite, or any other suitable smokable material known to one of ordinary skill in the art. The material 110 is configured to retain structure or positioning, as recessed with respect to the end 108, via compact packing/packaging or via including an adhesive or a bonding agent therein, whether or not configured to be at least human food safe or at least human edible. Note in other embodiments, the material 110 is a mix of smokable or non-smokable substances, whether visually distinct or indistinct from each other, such as via shape or color or pattern.

Figure 2:
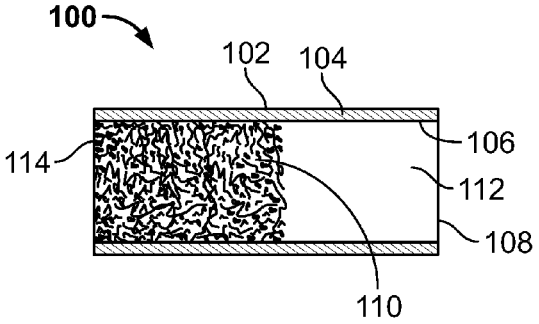
FIG. 2 shows a cross-sectional side view of an example embodiment of a unit according to the present disclosure.

FIG. 2 shows a cross-sectional side view of an example embodiment of a unit according to the present disclosure. Some elements of this figure are described above. Thus, same reference characters identify identical and/or like components described above and any repetitive detailed description thereof will hereinafter be omitted or simplified in order to avoid complication.

The space 112 is sized volumetrically identical to the material 110. However, in other embodiments, the space 112 is sized volumetrically greater than the material 110 or less than the material 110. The material 110 comprises an edge surface facing the space 110. Although such edge surface is extending perpendicular to the rectilinear extension of the tube 102, in other embodiments, such edge surface is extending non-perpendicular to the rectilinear extension of the tube 102, such as via being beveled by being diagonal to the rectilinear extension of the tube 102, whether with a positive slope or a negative slope, or arcuate, whether concave or convex. Note that such edge surface can also be configured to contain at least one depression, such as a well, which can be cylindrical, conical, or tapered. Note similar configuration can be implemented on the other edge surface. Also, note that the material 110 is sufficiently dense such that the material 110 prohibits substantial fluid communication therethrough, such as air flow. However, in other embodiments, the material 110 can be configured to define an internal channel therethrough so that fluid communication can occur via the channel, such as air flow, between both of the edge surfaces.

The tube 102 comprising a second end 114. The end 114 can be configured as the end 108 in any manner, as described herein and with respect to any component or an aspect/characteristic of the unit 100. Note that the material 110 is not recessed with respect to the end 114. Rather, the material 110 extends to the end 114. However, in other embodiments, the material 110 can be recessed with respect to the end 114 as the end 108 in any manner, as described herein and with respect to any component or an aspect/characteristic of the unit 100. The end 114 can be open or closed. The end 114 can be more open than the end 108, less open than the end 108 or equivalently open as the end 108.

Figure 3:
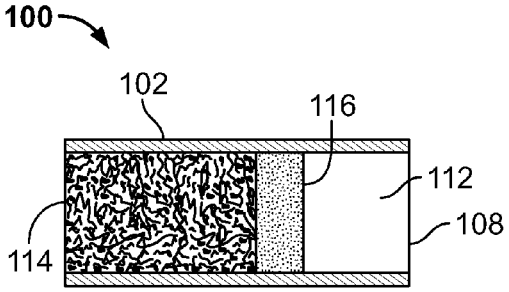
FIG. 3 shows a cross-sectional side view of an example embodiment of a unit containing a filter according to the present disclosure.

FIG. 3 shows a cross-sectional side view of an example embodiment of a unit containing a filter according to the present disclosure. Some elements of this figure are described above. Thus, same reference characters identify identical and/ or like components described above and any repetitive detailed description thereof will hereinafter be omitted or simplified in order to avoid complication.

The tube 102 comprises a filter 116 positioned in the space 112 between the end 114 and the end 108, while contacting the material 110. In other embodiments, the filter 116 avoids contacting the material 110. The filter 116 is configured to reduce an mount of at least one of smoke, tar, and a fine particle, which can be inhaled during combustion of the material 110. The filter 116 comprises cellulose acetate, but other materials can be used, whether additionally or alternatively, whether in part or in whole. The filter 116 is coupled to the tube 102 via adhering to the inner surface 106, whether via the filter 116 or via the inner surface 104. However, in other embodiments, the filter 116 is configured to retain positioning within the tube 102 via an expansive outward force applied via the filter 116 onto the tube 102 as limited via the a contractive inward force applied onto the filter 116 via the tube 102, such as via compaction.

Figure 4A:
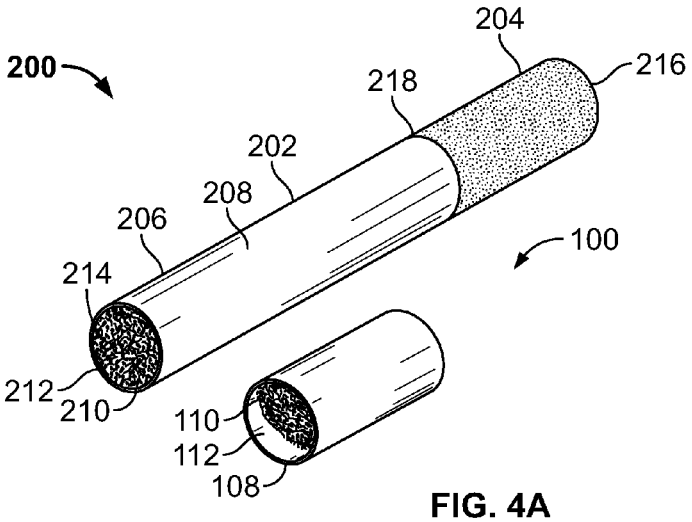
FIG. 4A shows a perspective view of an example embodiment of a unit relative to a cigarette according to the present disclosure.
Figure 4B:
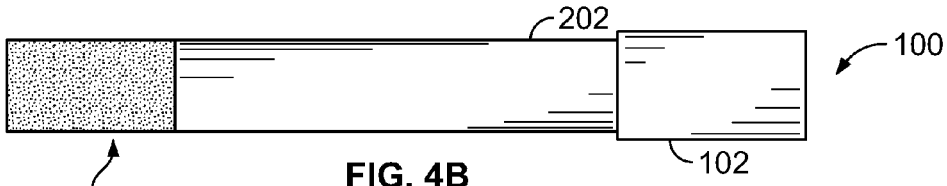
FIG. 4B shows a side view of an example embodiment of a unit coupled to a cigarette according to the present disclosure.
Figure 4C:
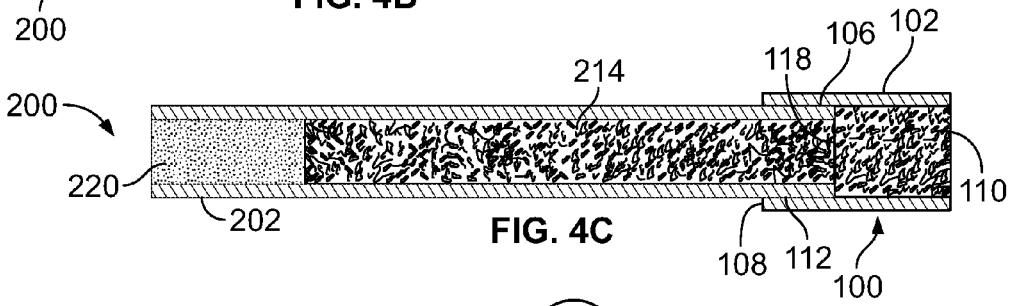
FIG. 4C shows a cross-sectional side view of an example embodiment of a unit coupled to a cigarette where a smokable material of the unit abuts a smokable material of the cigarette according to the present disclosure.

FIG. 4A shows a perspective view of an example embodiment of a unit relative to a cigarette according to the present disclosure. FIG. 4B shows a side view of an example embodiment of a unit coupled to a cigarette according to the present disclosure. FIG. 4C shows a cross-sectional side view of an example embodiment of a unit coupled to a cigarette where a smokable material of the unit abuts a smokable material of the cigarette according to the present disclosure. Some elements of this figure are described above. Thus, same reference characters identify identical and/or like components described above and any repetitive detailed description thereof will hereinafter be omitted or simplified in order to avoid complication.

A cigarette 200 is defined via a smokable material rod 202 and a filtration zone 204 extending from the rod 202. The rod 202 and the zone 204 meet with each other at a point 218. The rod 202 comprises a cigarette paper 206 comprising an outer surface 208 and an inner surface 210. The cigarette 200 comprises an open end 212 at the rod 202 and a closed end 216 at the zone 204. The end 216 is inserted into a smoker's mouth. The zone 204 comprises tipping paper. The rod 202 contains a smokable material 214, which can be any smokable material described herein. For example, the material 214 can comprise tobacco, cannabis, mesquite, or any other suitable smokable material known to one of ordinary skill in the art. The material 214 is in proximity of the end 212.

The end 108 is sized to receive a portion of the cigarette 200, which comprises the rod 202, which comprises the end 212 with the material 214. Therefore, the portion comprises the material 214. Accordingly, such reception is so that the portion is positioned within the space 112 so that the material 110 and the material 214 abut each other, such as via at least partially contacting each other, at a point 118. Note that the material 110 and the material 214 can be identical to or different from each other in any manner, such as type, sub-type, weight, density, volume, smoking characteristic, or any other measurable aspect.

The surface 106 contacts the surface 208 within the space 112. The end 212 can avoid reaching the end 114, such as via a resistance of the material 110 if the end 114 is closed. Also, if uncontrolled pushing occurs, then the end 212 can push the material 110 out of the tube 102 if the end 114 is open. In other embodiments, the tube 102 can be structured to limit longitudinal movement of the rod 202 such that the rod 202, such as via the end 212, meets resistance as the rod 202 is inserted further into the tube 102, such as via the tube 102 becoming narrower, such as being tapered or conically shaped.

Note that the rod 202 comprises such portion, the cigarette 200 comprises a first length and the tube 102 comprises a second length. As shown in FIGS. 4A-4C, the first length is greater than the second length. However, in other embodiments, the first length can be lesser than the second length or be equivalent thereto.

The zone 204 comprises a filter 220 positioned between the end 216 and the end 212. The filter 220 is configured to reduce an mount of at least one of smoke, tar, and a fine particle, which can be inhaled during combustion of the material 110 or the material 214. The filter 220 comprises cellulose acetate, but other materials can be used, whether additionally or alternatively, whether in part or in whole. The filter 220 is coupled to the zone 204 via adhering to the inner surface 210, whether via the filter 220 or via the inner surface 210. However, in other embodiments, the filter 220 is configured to retain positioning within the zone 204 via an expansive outward force applied via the filter 220 onto the zone 204 as limited via the a contractive inward force applied onto the filter 220 via the zone 204, such as via compaction.

Figure 5A:
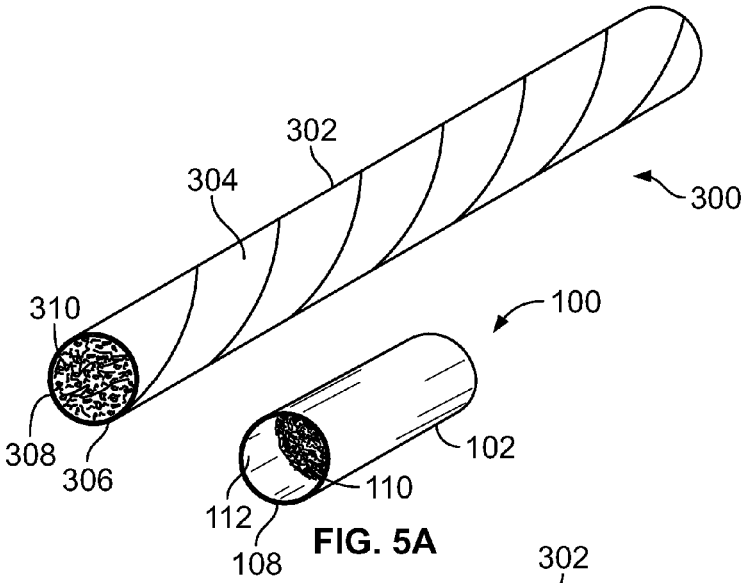
FIG. 5A shows a perspective view of an example embodiment of a unit relative to a cigar according to the present disclosure.
Figure 5B:
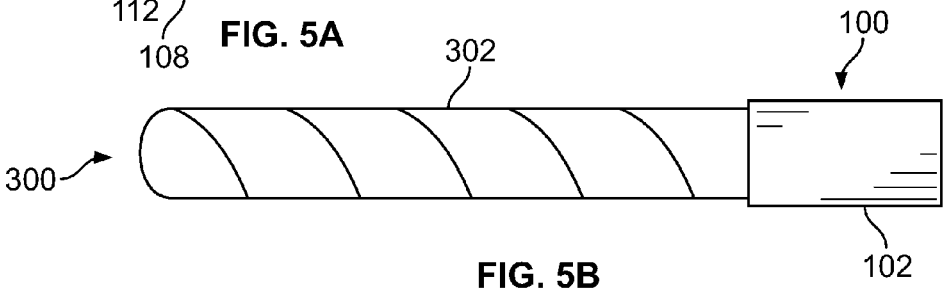
FIG. 5B shows a side view of an example embodiment of a unit coupled to a cigar according to the present disclosure.
Figure 5C:
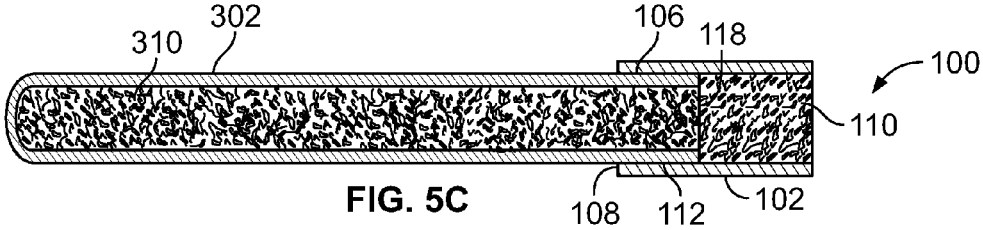
FIG. 5C shows a cross-sectional side view of an example embodiment of a unit coupled to a cigar where a smokable material of the unit abuts a smokable material of the cigar according to the present disclosure.

FIG. 5A shows a perspective view of an example embodiment of a unit relative to a cigar according to the present disclosure. FIG. 5B shows a side view of an example embodiment of a unit coupled to a cigar according to the present disclosure. FIG. 5C shows a cross-sectional side view of an example embodiment of a unit coupled to a cigar where a smokable material of the unit abuts a smokable material of the cigar according to the present disclosure. Some elements of this figure are described above. Thus, same reference characters identify identical and/or like components described above and any repetitive detailed description thereof will hereinafter be omitted or simplified in order to avoid complication.

A cigar 300 comprises a tube 302 comprising an outer surface 304 and an inner surface 306. The cigar 300 comprises an open end 308. The cigar 300 contains a smokable material 310, which can be any smokable material described herein. For example, the material 310 can comprise tobacco, cannabis, mesquite, or any other suitable smokable material known to one of ordinary skill in the art. The material 310 is in proximity of the end 308.

The end 108 is sized to receive a portion of the cigar 300, which comprises the end 308 with the material 310. Therefore, the portion comprises the material 310. Accordingly, such reception is so that the portion is positioned within the space 112 so that the material 110 and the material 310 abut each other, such as via at least partially contacting each other, at the point 118. Note that the material 110 and the material 310 can be identical to or different from each other in any manner, such as type, sub-type, weight, density, volume, smoking characteristic, or any other measurable aspect.

The surface 106 contacts the surface 304 within the space 112. The end 308 can avoid reaching the end 114, such as via a resistance of the material 110 if the end 114 is closed. Also, if uncontrolled pushing occurs, then the end 308 can push the material 110 out of the tube 102 if the end 114 is open. In other embodiments, the tube 102 can be structured to limit longitudinal movement of the tube 302 such that the tube 302, such as via the end 308, meets resistance as the tube 302 is inserted further into the tube 102, such as via the tube 102 becoming narrower, such as being tapered or conically shaped.

Note that the tube 302 comprises such portion, the cigar 300 comprises a first length and the tube 102 comprises a second length. As shown in FIGS. 5A-5C, the first length is greater than the second length. However, in other embodiments, the first length can be lesser than the second length or be equivalent thereto.

Figure 6:
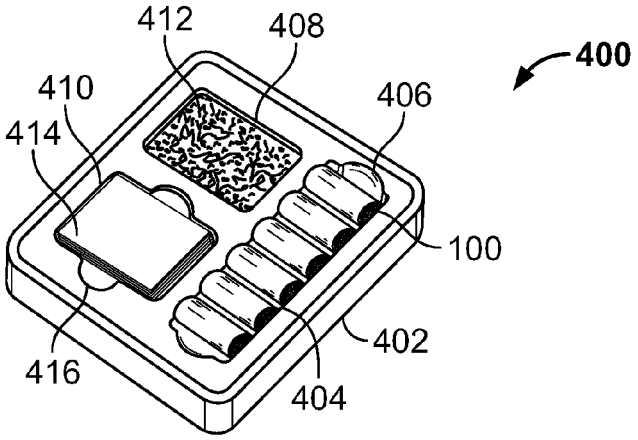
FIG. 6 shows a perspective view of an example embodiment of a package comprising a kit according to the present disclosure.

FIG. 6 shows a perspective view of an example embodiment of a package comprising a kit according to the present disclosure. Some elements of this figure are described above. Thus, same reference characters identify identical and/or like components described above and any repetitive detailed description thereof will hereinafter be omitted or simplified in order to avoid complication.

A package 400 comprises a storage case 402 comprising a unit well 404, a rolling material well 410, and a smokable material well 408. The case 402 comprises plastic, but can comprise metal, wood, glass, gemstone, rubber, or any combinations thereof. The case 402 can be rigid, flexible, stretchable, or elastic. The case 402 can be solid or perforated, whether in any part or in whole. The case 402 can be configured to be waterproof. Whether internally or externally, the case 402 can be smooth, rough, textured, rugged, uncoated, or coated with an agent configured to improve or degrade at least one of a smoking quality, a smoking flavor, a filtering characteristic, a smoldering characteristic, or affect in any way an aspect of smoking via the unit 100. The case 402 can be fit for human consumption, whether flavored or unflavored, whether or not configured to be at least human food safe. For example, the case 402 can comprise tobacco, cannabis, mesquite, or any other suitable smokable material known to one of ordinary skill in the art. The case 402 can be covered with a lid, which can be pivotally coupled to the case, such as via a hinge.

The well 404 stores the units 100. Note that the well 404 can store at least one of the units. More than one well 404 can be formed on the case 402. The well 404 can be of any shape or depth. The well 404 can be perforated. The well 404 comprises a pair of opposing ramps 406 configured to allow for easy grasping of at least one of the units 100 stored in the well 404.

The well 410 stores a quantity of rolling material 414, such as a set of rolling paper sheets. More than one well 410 can be formed on the case 402. The well 410 can be of any shape or depth. The well 410 can be perforated. For example, the material 414 can be positioned in a stack. The well 410 comprises a pair of opposing ramps 416 configured to allow for easy grasping of the material stored in the well 410.

The well 408 stores a quantity of third smokable material 412, which can be any smokable material described herein. More than one well 408 can be formed on the case 402. The well 408 can be of any shape or depth. The well 408 can be perforated. For example, the material 412 can comprise tobacco, cannabis, mesquite, or any other suitable smokable material known to one of ordinary skill in the art. Note that the material 110 and the material 408 can be identical to each other in type, such as both being tobacco of one type or both being cannabis of one type. However, in other embodiments, the material 110 and the material 408 can be different from each other in type, such as the material 110 can be a first tobacco blend and the material 408 can be a second tobacco blend, different from the first blend, or the material 110 can be cannabis and the material 408 can be a tobacco blend.

Figure 7:
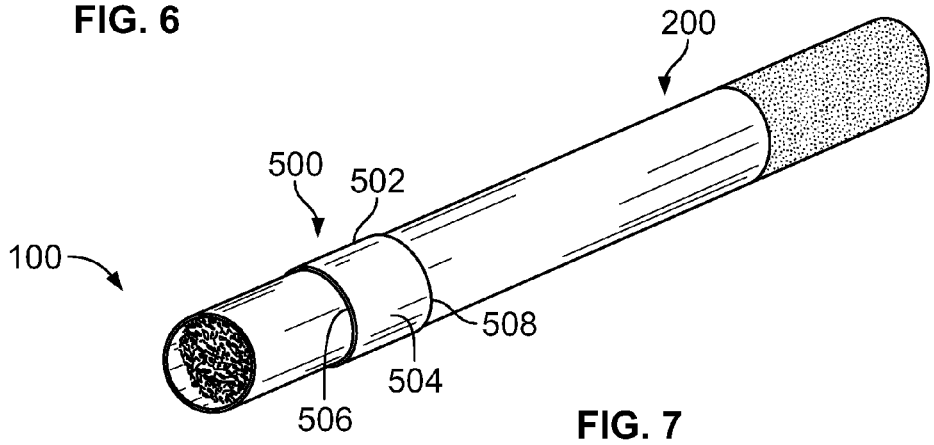
FIG. 7 shows a perspective view of an example embodiment of a band mounted over a unit and a cigarette according to the present disclosure.

FIG. 7 shows a perspective view of an example embodiment of a band mounted over a unit and a cigarette according to the present disclosure. Some elements of this figure are described above. Thus, same reference characters identify identical and/or like components described above and any repetitive detailed description thereof will hereinafter be omitted or simplified in order to avoid complication.

A band 500 comprises a tube 502 comprising an outer surface 504, a first open end 506 and a second open end 508 extending therebetween. The end 506 and the end 508 can be identical to or different from each other in any way, such as described herein with respect to the end 108 and the end 114. At least one of the end 506 and the end 508 can be structured/arranged in any way identical to or different from at least one of the end 108 and the end 114, as described herein. The tube 502 can be structured/arranged in any way identical to or different from the tube 102, as described herein.

The tube 502 mounts over the tube 102, such as via sliding from the end 114 toward the end 108, to enhance how securely the tube 102 contains the portion of the cigarette 200 in the space 112 or the cigar 300 in the space 112, such as via applying inward pressure, as if an elastic band applying inward pressure onto a cylinder when the band is mounted onto the cylinder. Note though that the tube 502 can be elastic or inelastic, such as rigid. Also, note that such pressure is sufficient to enhance the tube 102 containing the portion of the cigarette 200 in the space 112 or the cigar 300 in the space 112, yet also sufficient so as not to interfere with smoking of the substance 110 and the substance 214 or the substance 310 via obstructing smoldering path therebetween. The tube 502 can also be configured to mount directly over the portion of the cigarette 200, such as over the rod 200 past the end 212, or the cigar 300, such as over the tube 300 past the end 310. In such configurations, an inner surface of the tube 502 can accommodate for a height drop corresponding to a thickness of the tube 502. For example, such accommodation can be manifested through the inner surface being diagonal between the end 506 and the end 508 or the tube 502 having a varying thickness.

Figure 8A:
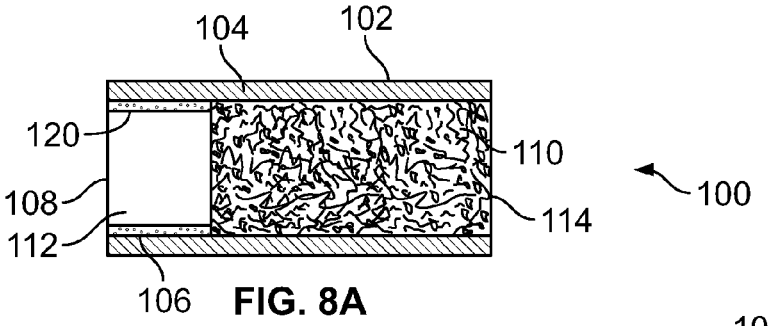
FIG. 8A shows a cross-sectional side view of an example embodiment of a unit comprising an inner adhesive section according to the present disclosure.

FIG. 8A shows a cross-sectional side view of an example embodiment of a unit comprising an inner adhesive section according to the present disclosure. Some elements of this figure are described above. Thus, same reference characters identify identical and/or like components described above and any repetitive detailed description thereof will hereinafter be omitted or simplified in order to avoid complication.

The surface 106, whether in part or in whole, comprises an adhesive 120 facing the space 112. The adhesive 120, whether or not configured to be at least human food safe or at least human edible, whether flavored or unflavored, is configured to adhere onto the surface 208 of the cigarette 200 in the space 112 or the surface 304 of the cigar 300 in the space 112 to enhance how securely the tube 102 contains the portion of the cigarette 200 in the space 112 or the cigar 300 in the space 112.

Figure 8B:
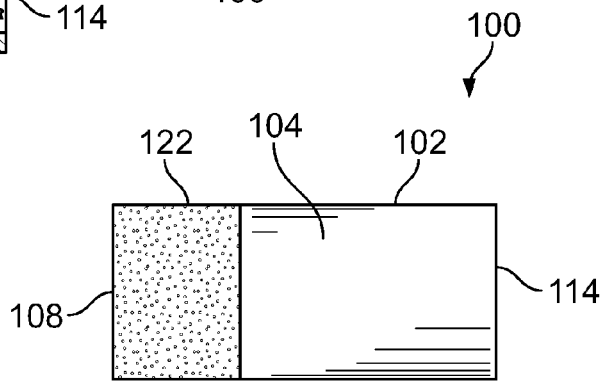
FIG. 8B shows a side view of an example embodiment of a unit comprising an outer adhesive section according to the present disclosure.

FIG. 8B shows a side view of an example embodiment of a unit comprising an outer adhesive section according to the present disclosure. Some elements of this figure are described above. Thus, same reference characters identify identical and/or like components described above and any repetitive detailed description thereof will hereinafter be omitted or simplified in order to avoid complication.

The surface 104, whether in part or in whole, comprises an adhesive 122 external to the space 112, yet disposed over the space 112. The adhesive 122 can be configured to be at least human food safe or at least human edible, whether flavored or unflavored. The adhesive 122 can be configured to adhere to the surface 210 of the cigarette 200 in proximity of the end 212 or the surface 306 of the cigar 300 in proximity to the end 308 when the unit 100 is inserted into the cigarette 200 or the cigar 300, which is a reverse of what is shown in FIGS. 4A-5C.

Figure 9A:
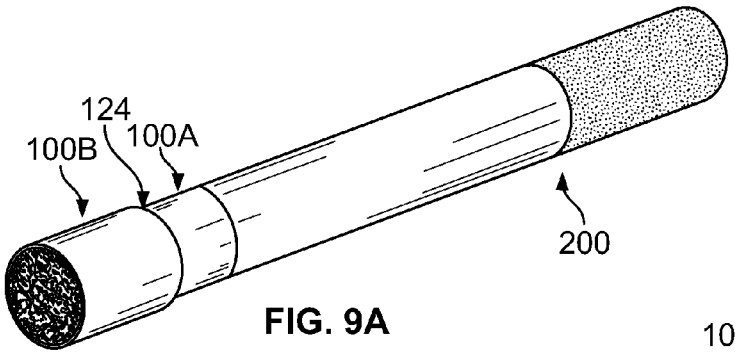
FIG. 9A shows a perspective view of an example embodiment of a unit train according to the present disclosure.
Figure 9B:
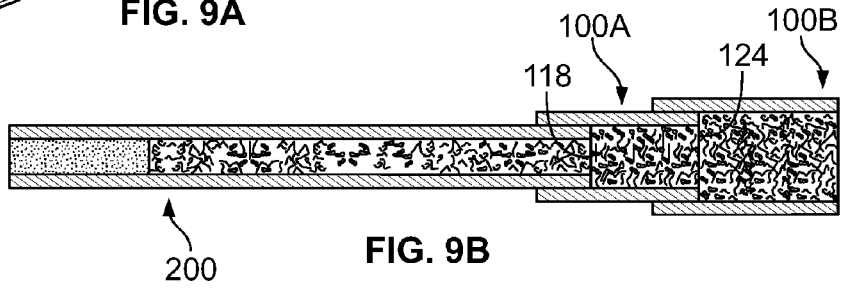
FIG. 9B shows a cross-sectional side view of an example embodiment of a unit train according to the present disclosure.

FIG. 9A shows a perspective view of an example embodiment of a unit train according to the present disclosure. FIG. 9B shows a cross-sectional side view of an example embodiment of a unit train according to the present disclosure. Some elements of this figure are described above. Thus, same reference characters identify identical and/or like components described above and any repetitive detailed description thereof will hereinafter be omitted or simplified in order to avoid complication.

A unit train comprises a unit 100A and a unit 100B. The unit 100A is in receipt of the cigarette 200 in a manner as described above, where the material 110 of the unit 100A abuts the material 214 of the cigarette 200 at the point 118. The unit 100B is in receipt of the unit 100A, in a same manner as the unit 100A is in receipt of the cigarette 200, such as nesting or telescoping, where the material 110 of the unit 100A abuts the material 110 of the unit 110B at a point 124 in the space 112 of the unit 100B, with the unit 100A being positioned between the cigarette 200 and the unit 100B. Note that the material 110 of the unit 100A and the material 110 of the unit 110B can be identical to or different from each other in any manner, such as type, sub-type, weight, density, volume, smoking characteristic, or any other measurable aspect.

Figure 9C:
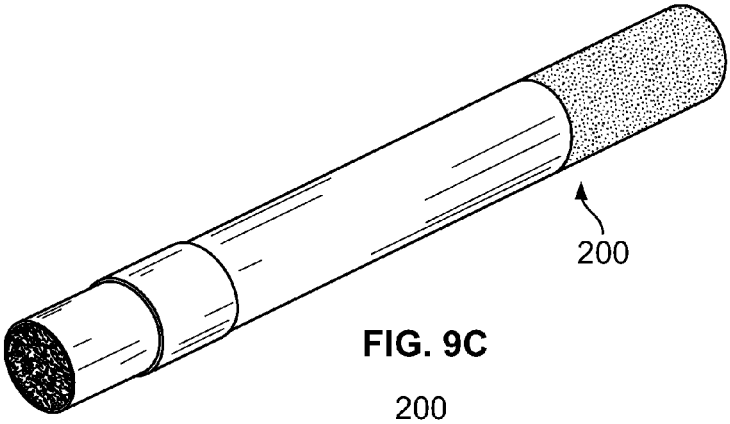
FIG. 9C shows a perspective view of an example embodiment of a unit train according to the present disclosure.
Figure 9D:
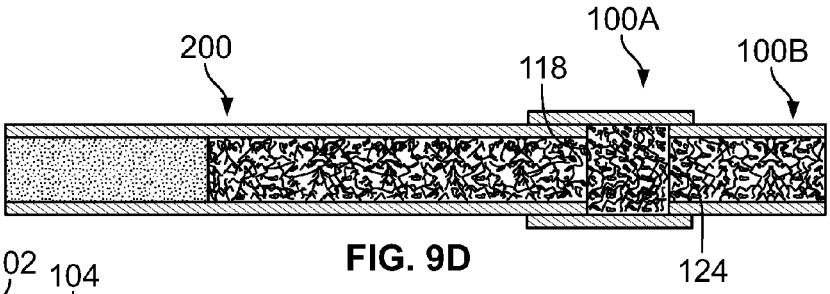
FIG. 9D shows a cross-sectional side view of an example embodiment of a unit train according to the present disclosure.

FIG. 9C shows a perspective view of an example embodiment of a unit train according to the present disclosure. FIG. 9D shows a cross-sectional side view of an example embodiment of a unit train according to the present disclosure. Some elements of this figure are described above. Thus, same reference characters identify identical and/or like components described above and any repetitive detailed description thereof will hereinafter be omitted or simplified in order to avoid complication.

A unit train comprises the unit 100A and the unit 100B. The unit 100A is in receipt of the cigarette 200 in the manner as described above, where the material 110 of the unit 100A abuts the material 214 of the cigarette 200 at the point 118. The unit 100A is also in receipt of the unit 100B in a same manner as the unit 100A is in receipt of the cigarette 200, such as nesting or telescoping, where the material 110 of the unit 100A abuts the material 110 of the unit 110B at the point 124 within the space 112 of the unit 100A, with the unit 100A being positioned between the cigarette 200 and the unit 100B.

Figure 10:
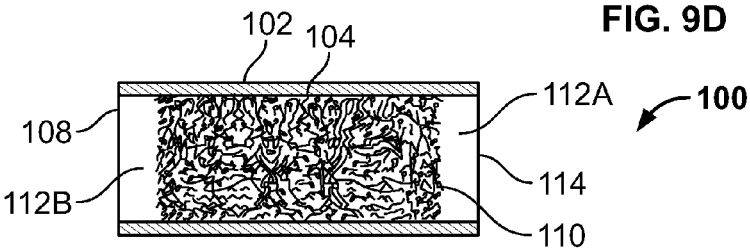
FIG. 10 shows a cross-sectional side view of an example embodiment of a unit recessed from both sides according to the present disclosure.

FIG. 10 shows a cross-sectional side view of an example embodiment of a unit recessed from both sides according to the present disclosure. Some elements of this figure are described above. Thus, same reference characters identify identical and/or like components described above and any repetitive detailed description thereof will hereinafter be omitted or simplified in order to avoid complication.

The tube 102 comprises a space 112A and a space 1128. The space 112A is defined via the end 114, which can be closed or open, and the material 110 being recessed with respect to the end 114. The space 1128 is defined via the end 108, which can be closed or open, and the material 110 being recessed with respect to the end 108. Therefore, the material 110 is recessed within the tube 102 with respect to the end 108 and to the end 114. The material 110 is configured to retain structure or positioning, as recessed with respect to the end 108 and to the end 114, via compact packing/packaging or via including an adhesive or a bonding agent therein, whether or not configured to be at least human food safe or at least human edible.

The space 112A and the space 1128 are identical to each other in volume. In other embodiments, the space 112A and the space 1128 are different from each other in volume. The space 112A and the space 1128 can be volumetrically symmetrical or asymmetrical to each other.

In some embodiments, various functions or acts can take place at a given location and/or in connection with the operation of one or more apparatuses or systems. In some embodiments, a portion of a given function or act can be performed at a first device or location, and the remainder of the function or act can be performed at one or more additional devices or locations.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the form disclosed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

The description of the present disclosure has been presented for purposes of illustration and description, but is not intended to be fully exhaustive and/or limited to the disclosure in the form disclosed. Many modifications and variations in techniques and structures will be apparent to those of ordinary skill in the art without departing from the scope and spirit of the disclosure as set forth in the claims that follow. Accordingly, such modifications and variations are contemplated as being a part of the present disclosure. The scope of the present disclosure is defined by the claims, which includes known equivalents and unforeseeable equivalents at the time of filing of the present disclosure.

The invention claimed is:

1. A method comprising:

accessing a first tube which contains a first smokable material recessed with respect to a first open end of the first tube such that a first open space within the first tube is defined between the first open end and the first smokable material, wherein the first tube comprises a first longitudinal length, wherein a furthermost end of the first tube comprises a first tube distal end portion;

accessing a cigarette which contains a rod of a second smokable material and a filtration zone attached to and extending from the rod, wherein a furthermost end of the rod of the second smokable material comprises a cigarette distal end portion, wherein a furthermost end of the filtration zone is configured for smoke inhalation and comprises a cigarette proximal end portion, wherein the cigarette comprises a second longitudinal length greater than the first longitudinal length;

accessing a second tube which contains a third smokable material recessed with respect to a second open end of the second tube such that a second open space within the second tube is defined between the second open end and the third smokable material, wherein the second tube comprises a third longitudinal length lesser than the second longitudinal length;

inserting the cigarette distal end portion into the first open end of the first tube such that the cigarette distal end portion is positioned in the first open space and the second smokable material abuts the first smokable material in the first open space; and nesting the second open end of the second tube onto the first tube distal end portion such that the first tube distal end portion is positioned within the second open space and the first smokable material abuts the third smokable material in the second open space, wherein a smoldering path is established from the third smokable material to the first smokable material to the second smokable material.

2. The method of claim 1, wherein a furthermost end of the second tube comprises a second tube distal end portion which is open.

3. The method of claim 2, wherein the third smokable material extends to the second tube distal end portion.

4. The method of claim 2, wherein the third smokable material is recessed with respect to the second tube distal end portion such that a third open space is defined thereby.

5. The method of claim 4, wherein the third open space and the second open space are identical to each other in volume.

6. The method of claim 4, wherein the third open space and the second open space are different from each other in volume.

7. The method of claim 1, wherein at least one of the first tube or the second tube comprises an outer surface external to at least one of the first open space or the second open space, wherein the outer surface is disposed over at least one of the first open space or the second open space, wherein the outer surface comprises an adhesive.

8. The method of claim 1, wherein a furthermost end of the second tube comprises a second tube distal end portion which is closed.

9. The method of claim 1, wherein at least one of the first tube or the second tube comprises a rolling paper.

10. The method of claim 1, further comprising:

mounting a band supportively over at least one of the first tube or the second tube.

11. The method of claim 1, wherein at least one of the first tube or the second tube is configured for a single use.

12. The method of claim 1, wherein at least one of the first tube or the second tube comprises an inner surface facing at least one of the first open space or the second open space, wherein the inner surface comprises an adhesive.

13. The method of claim 1, wherein at least one of the first tube or the second tube is a right circular cylinder.

14. The method of claim 1, wherein the first open space and the second open space are identical to each other in volume.

15. The method of claim 1, wherein the first open space and the second open space are different from each other in volume.

* * * * *